United States Patent [19]

Artzt et al.

[11] Patent Number: 4,633,660

[45] Date of Patent: Jan. 6, 1987

[54] PROCESS AND APPARATUS FOR REJOINING A THREAD ON AN OPEN-END FRICTION-SPINNING DEVICE

[75] Inventors: Peter Artzt; Gerhard Egbers; Hans Rottmayr, all of Reutlingen, Fed. Rep. of Germany

[73] Assignee: Schubert & Salzer, Ingolstadt, Fed. Rep. of Germany

[21] Appl. No.: 770,209

[22] Filed: Aug. 28, 1985

[51] Int. Cl.[4] ..... D01H 15/02

[52] U.S. Cl. ..... 57/263

[58] Field of Search ..... 57/263, 401

[56] References Cited

U.S. PATENT DOCUMENTS 4,539,804 9/1985 Derichs ..... 57/401 X 4,541,234 9/1985 Wassenhoven et al. ..... 57/401 X

*Primary Examiner*—Donald Watkins

*Attorney, Agent, or Firm*—Dority & Manning

[57] ABSTRACT

A process for rejoining the thread on an open-end friction-spinning device, in which fibers are fed into a V-shaped nip subjected to suction, and the thread formed in the V-shaped nip is drawn off from this and wound onto a bobbin. For rejoining, the fiber feed into the V-shaped nip is interrupted and a thread end drawn off from the bobbin is guided towards the V-shaped nip counter to the spinning direction. This thread end is paid out in front of the V-shaped nip and is stored in a joinable length in a storage station at the end of the V-shaped nip facing away from the bobbin. The bobbin is then advanced towards its drive roller and the thread is drawn off from the storage station. After a predetermined time after the start of the thread draw-off, the fibers are fed again into the V-shaped nip, where they come up against the thread end running through the V-shaped nip and are twisted together with this.

30 Claims, 5 Drawing Figures

FIG. 5
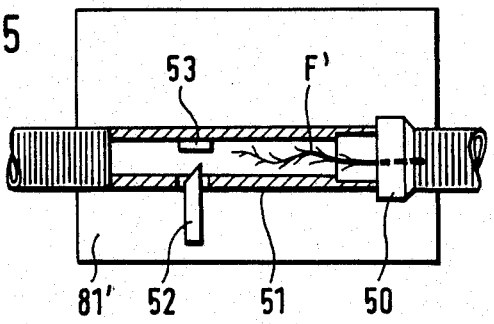
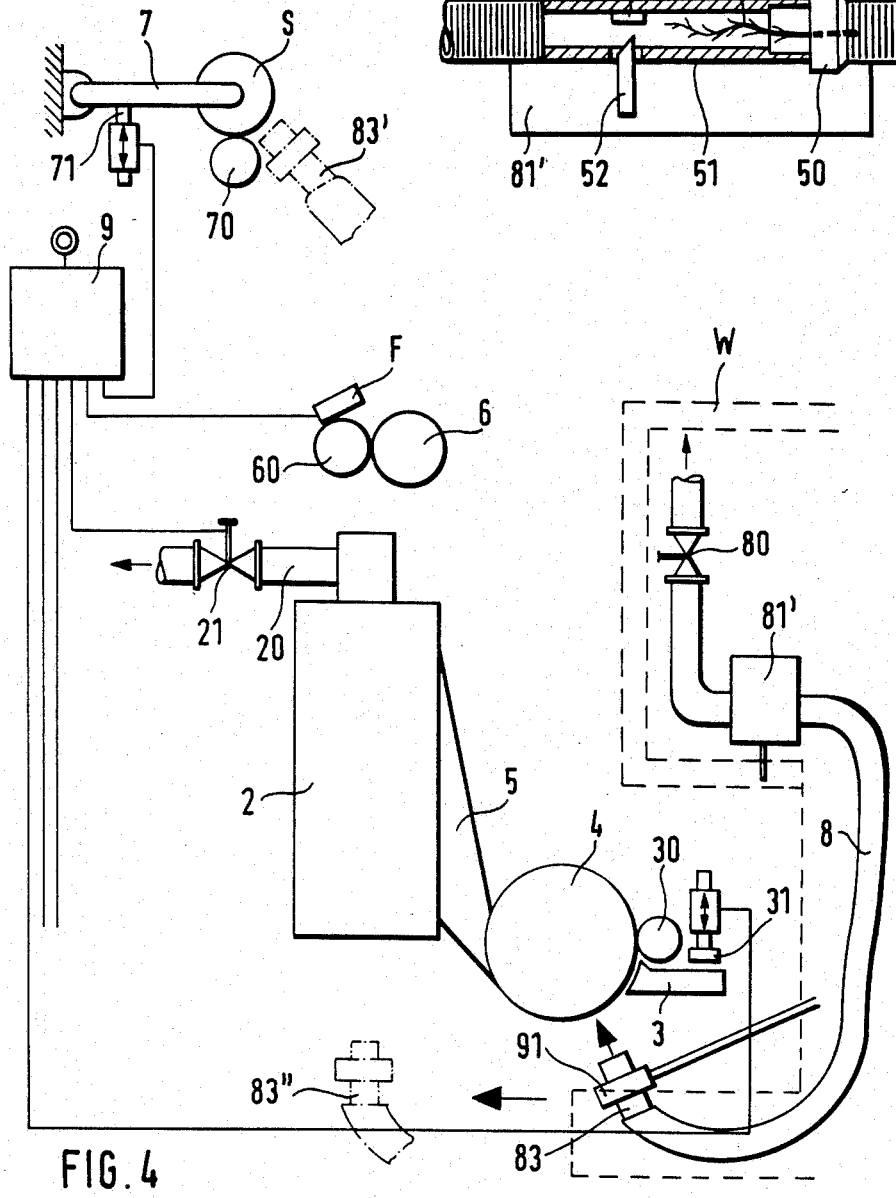
FIG. 4

PROCESS AND APPARATUS FOR REJOINING A THREAD ON AN OPEN-END FRICTION-SPINNING DEVICE

The invention relates to a process for rejoining the thread on an open-end friction-spinning device, in which fibers are fed into a V-shaped nip subjected to suction, and the thread formed in the V-shaped nip is drawn off from this and wound onto a bobbin, and, for rejoining, the fiber feed into the V-shaped nip is interrupted and a thread end drawn off from the bobbin is guided towards the V-shaped nip counter to the spinning direction, and to an apparatus for carrying out the process.

Various designs of open-end friction-spinning devices are known from the state of the art. Recently, development in this sector has concentrated on devices with rotationally symmetrical friction elements which form a V-shaped nip or gusset and at least one of which is perforated and provided with a suction insert connected to a suction device (German Patent Specification No. 2,449,583; European Preliminary Publication No. 0,031,250; German Offenlegungsschrift No. 2,714,089). As a rule, cylindrical, conical or hyperbolic rollers are used as friction elements and a sliver supplied is opened up into individual fibers by an opening roller. The fibers fed through a feed channel into the V-shaped nip subjected to suction are twisted together in this as a result of friction and are drawn off from the V-shaped nip as yarn and wound onto a bobbin. In this way, a yarn can be manufactured at a high production rate. However, friction-spinning can be used on an industrial scale and is economical only when it is possible to rejoin the thread on the device without difficulty and reliably.

Ideas on rejoining threads along the lines of automation of a friction spinning machine are known from the literature (W. Topf: Friction-spinning—Thoughts on a future spinning process. Chemiefasern/Textilindustrie, April 1984, page 278/279). According to this, in the event of a thread breakage the fiber feed is to be interrupted, the spinning unit cleaned and then fiber material supplied again, and the yarn end taken up by the cross-wound bobbin is to be introduced into the spinning gusset counter to the spinning direction. However, there is no solution to the problem of joining the supplied fibers to the yarn end properly and reliably.

The object of the invention is to provide a process and an apparatus which in a simple way allow a thread on a friction-spinning device to be rejoined reliably, at the same time giving the joining point an inconspicuous appearance and the strength necessary for the further processing of the thread.

According to the invention, the object is achieved because the thread end is paid out in front of the V-shaped nip and is stored in a joinable length in a storage station at the end of the V-shaped nip facing away from the bobbin, whereupon the bobbin is advanced towards its drive roller and the thread is drawn off from the storage station, and because, after a predetermined time after the start of the thread draw-off, the thread feed into the V-shaped nip is resumed, so that the fibers supplied come up against the thread end running through the V-shaped nip and are twisted together with this.

It becomes easier to pay out the joining thread when the thread end is paid out in front of a V-shaped nip extending vertically. The thread end is preferably stored in a pneumatic storage station, the suction-air stream of which can be used for paying out. It becomes possible to pay out the thread faultlessly close in front of and along the V-shaped nip if the suction exerted on the V-shaped nip is interrupted before the paying-out operation. In a simple way and without any additional outlay, the friction elements are cleaned before the paying-out of the thread end by being driven in the opposite direction to the direction of rotation for spinning, the residual fibers coming loose from them being sucked into the storage station.

A joining length of the thread end co-ordinated with the supply speed of the spinning device is obtained if a metered thread length is stored in the storage station. However, there is no need for any metering if a thread length exceeding a predetermined joining length is stored in the storage station and the absolute thread end is sensed during the thread draw-off. To avoid the need for a traversing of the thread until joining, the thread end paid out in front of the V-shaped nip is held elastically at a distance from the thread transfer device. It becomes unnecessary to lift off the pressure roller of the pair of draw-off rollers because the thread end drawn off from the bobbin is guided laterally past the pair of draw-off rollers and held elastically at a distance from the nip line of the pair of draw-off rollers. The thread-joining conditions are further improved if the thread end is prepared for joining before the paying-out operation.

The apparatus for carrying out the process, with two rotationally symmetrical friction elements which form a V-shaped nip and at least one of which is perforated and connected to a suction device via a suction tube, with a fiber feed device having a sliver supply and opening device and with a thread monitor arranged between a pair of drawoff rollers and a spooling device, is defined by a bobbin lift-off device, a sliver clamping device assigned to the sliver supply device and a thread store arranged in front of the friction elements in a spinning direction.

The thread store is preferably designed as a suction tube and a closing member is assigned to it. In the event of a thread breakage, it becomes possible to actuate the bobbin lift-off device and the sliver clamping device quickly and simultaneously and to open the closing member of the thread store and close a closing member assigned to the suction tube of the friction element if these devices can be controlled via the thread monitor. Supplied fibers are rejoined in a functionally reliable way to the paid-out thread end if the bobbin lift-off device, the sliver clamping device and the closing member of the suction tube and thread store can be controlled according to a time-fixed program. The control is preferably carried out by means of a microprocessor. Rejoining can be carried out in a simple way on the spinning device with a predetermined joining length of the thread end if a thread sensing device is assigned to the thread store. There is consequently no need to meter the thread end before the paying-out operation. The thread sensing device is appropriately a light barrier.

Additional means of eliminating the residual fibers which have come loose during the cleaning of the friction elements are avoided if the thread store is at the same time a suction device for the residual fibers coming loose from the friction elements. Traversing movements of the paid-out thread end before rejoining are prevented by an elastic thread guide element arranged in front of the thread transfer device belonging to the spooling device. Appropriately, the pair of draw-off rollers has assigned to it an elastic thread guide element which holds the thread at a distance from it, so that it is not necessary to lift off the pressure roller of the pair of draw-off rollers. Because the friction elements are arranged vertically upright, this greatly assists the paying-out of the thread end in front of the V-shaped nip.

The invention is described below with reference to an exemplary embodiment illustrated in the attached drawings.

In the drawings:

FIG. 4 shows, in a side view, an open-end friction-spinning device with a thread store arranged on a servicing trolley; and FIG. 5 shows, in an enlarged representation, a device arranged in the thread store for preparing the thread end.

Figure 1:
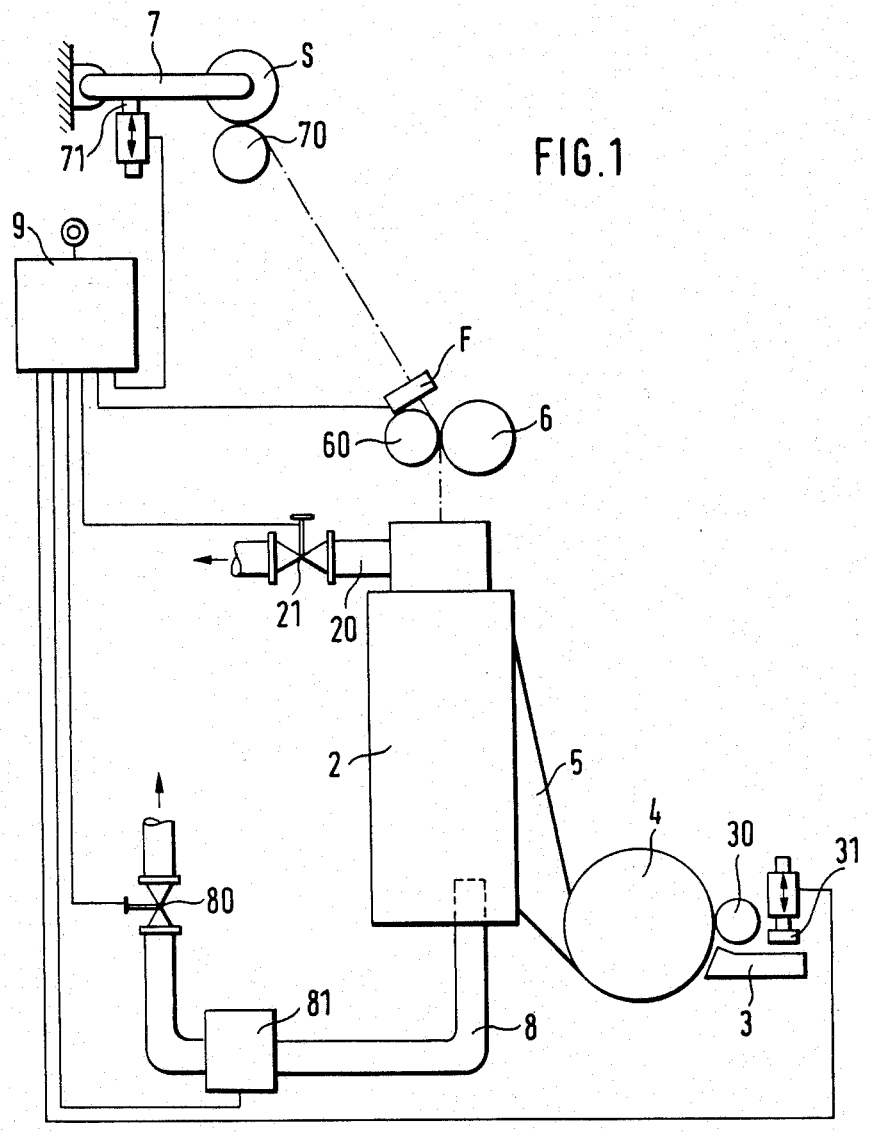
FIG. 1 shows, in a side view, an open-end friction-spinning device in the design according to the invention, during the spinning operation.
Figure 2:
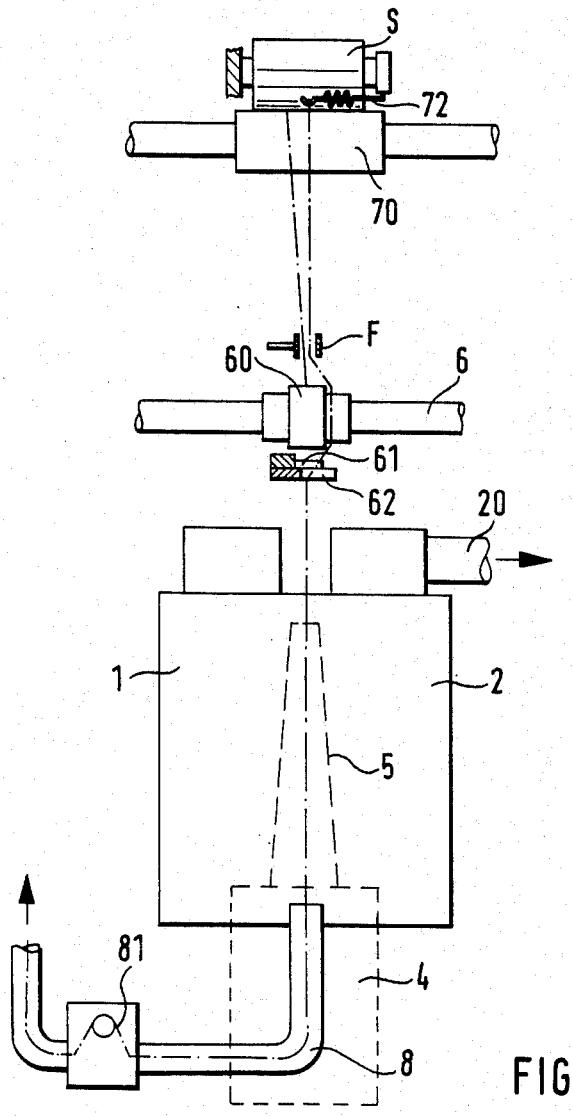
FIG. 2 shows, in a front view, the spinning device according to FIG. 1 with a paid-out joining thread.

According to FIGS. 1 and 2, the spinning device contains two rotationally symmetrical friction elements in the form of two cylindrical rollers 1 and 2 which are mounted vertically upright and form a V-shaped nip or gusset. The vertical arrangement of the friction rollers 1 and 2 is preferred because it assists the paying out of the joining thread described later, but the friction rollers 1 and 2 can also be arranged in any other position, for example in a horizontal position. At least one of the friction rollers, the friction roller 2 in the exemplary embodiment, is perforated and during spinning is subjected to suction in the region of the V-shaped nip. For this purpose, it is connected to a suction device (not shown) via a suction tube 20 with a closing member 21, for example a slide or valve. The two friction rollers 1 and 2 are driven in the same direction in a known way.

Located in front of the friction rollers 1 and 2 is a fiber supply device which contains a feed table 3 with a feed roller 30, an opening roller 4 and a fiber feed channel 5. A sliver clamping device 31 is arranged above the feed table 3 and in front of the feed roller 30.

The yarn is drawn off from the V-shaped nip existing between the friction rollers 1 and 2 by a pair of draw-off rollers which consists of a drive roller 6 and a pressure roller 60 pressed against the drive roller 6 by a loading means. The drawn-off yarn is wound onto a bobbin S which is held in bobbin arms 7 and which is driven by a bobbin drive roller 70 as result of friction. In the present case, the bobbin drive roller is designed as a slotted drum and consequently at the same time performs the function of thread transfer for the formation of the bobbin. However, thread transfer can also be carried out, for example, by a separate traversing thread guide. A bobbin lift-off device 71, with a ram which can be pressed against the bobbin arm 7, is assigned to the bobbin S.

For rejoining, a thread store 8 is arranged in front of the rollers 1 and 2, as seen in the spinning direction. In the preferred design illustrated, the thread store 8 is designed as a suction tube, the suction orifice of which extends somewhat into the V-shaped nip formed by the friction rollers 1 and 2 and the other end of which is connected to the suction device, with a closing member 80 interposed.

The thread is monitored between the pair of drawoff rollers 6, 60 and the bobbin S by a thread monitor F located in the vicinity of the pair of draw-off rollers 6, 60. As is evident from FIG. 1, the thread monitor F is connected electrically to a microprocessor 9, via which the bobbin lift-off device 71, the sliver clamping device 31 and the closing members 21 and 80 of the suction line 20 and thread store 8 can be controlled. The microprocessor 9 is also connected electrically to a thread sensing device 81 which is assigned to the thread store 8 and in the exemplary embodiment is a light barrier.

During the spinning operation, the sliver clamping device 31 is at a distance from the feed table 3 which guarantees that the sliver to be spun can pass through to the feed roller 30 and opening roller 4, and the bobbin S is in contact with the bobbin drive roller 70 (FIG. 1). The closing member 80 for the thread store 8 is closed and the closing member 21 assigned to the suction tube 20 is open, so that the V-shaped nip between the rotating friction rollers 1 and 2 is subjected to suction.

When a thread breakage occurs, the thread monitor F detects the absence of the thread and transmits a signal to the microprocessor 9. In response, this simultaneously transmits a control pulse to the bobbin lift-off device 71, the sliver clamping device 31 and the closing members 21 and 80, causing the bobbin lift-off device 71 to lift the bobbin S off from the bobbin drive roller 70, the sliver clamping device to clamp the sliver on the feed table and the closing member 21 to assume the closing position and the closing member 80 the open position. Mechanisms for moving the devices 31 and 71 and the closing members 21 and 80 are known per se, so there is no need for a more detailed description. For example, the movement of the bobbin lift-off device 71 and the sliver clamping device 31 into the lift-off position and clamping position respectively and the movement of the closing members into the closing position can be executed by means of an electromagnet and the return movement by means of springs.

Figure 3:
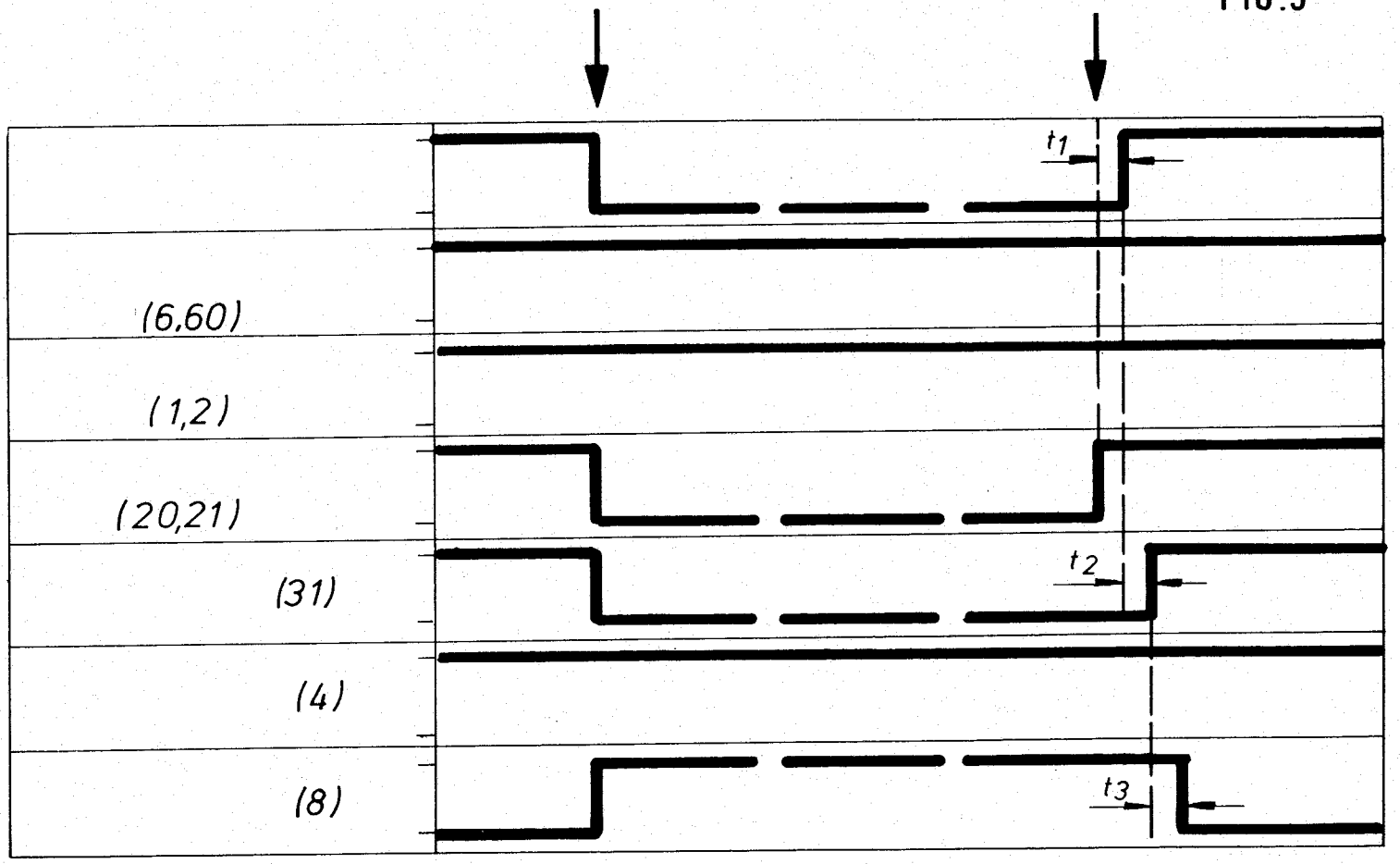
FIG. 3 shows a function/time diagram.

When the sliver is clamped by the sliver clamping device 31 pressed against the feed table 3 and when the suction line 20 is closed, the feed into the V-shaped nip between the friction rollers 1 and 2 and the suction exerted on the V-shaped nip are interrupted. The thread store 8 is connected to the suction device as result of the opening of the closing member 80, so that a partial vacuum prevails in the thread store 8. These operating states are represented in the function/time diagram according to FIG. 3. It is also evident from this that the opening roller 4, the friction rollers 1 and 2 and the pair of draw-off rollers 6, 60 continue to rotate. According to practical experience up to the present time, there are consequently no adverse effects on the thread-joining operation.

The spinning device is thus prepared for the joining thread to be paid out. However, the friction rollers 1 and 2 are appropriately cleaned beforehand, and in particular residual fibers still fed into the V-shaped nip after the clamping of the sliver have to be removed from it. This can be carried out in a simple way if the friction rollers 1 and 2 are driven for a short time counter to their direction of rotation for spinning. The residual fibers rolled together are thereby moved out of the V-shaped nip and seized by the suction-air stream of the thread store 8 which conveys them into the thread store 8 and eliminates them through this. Other cleaning methods, for example mechanically by means of a brush or a yarn end introduced into the V-shaped nip, are of course also possible.

After the friction rollers have been cleaned, a thread end is unwound from the bobbin S and appropriately is prepared for joining in a way known per se, for example as result of the roughening of the thread surface, to increase the success rate for joining and the strength of the join. The thread end is then paid out in front of the V-shaped nip and stored in the thread store 8 in a specific length (FIG. 2). The thread length which has to be contained in the thread store 8 depends on the spinning speed and can be metered accordingly. However, to avoid the need for metering, a thread length exceeding a predetermined joining length is preferably stored in the thread store 8 and the absolute end of the thread is sensed by the thread sensing device 81 when it is drawn off from the thread store.

A traversing movement of the paid-out thread is to be avoided as far as possible, since this can result in faults during the joining of the thread. Consequently, when the thread is paid out, the thread end is guided over a spring band 72 arranged in front of the bobbin drive roller 70 designed as a slotted drum, and is thus kept away from the bobbin drive roller 70. Likewise, a spring band 61 prevents the thread end from passing into the nip line of the pair of draw-off rollers 6, 60 before joining, when the pressure roller 60 is not to be lifted off from the drive roller 6. The thread end, after passing the thread monitor F, is guided laterally past the pair of draw-off rollers 6, 60, laid over the spring band 61 and threaded into a thread guide 62 with automatic threading-in. The thread end is then introduced into the V-shaped nip, in front of which it is paid-out with the assistance of the suction-air stream of the thread store 8 acting in the V-shaped nip and is sucked into the thread store 8, at the same time passing the thread sensing device 81.

After the thread end has been paid out in the way described, this being assisted and simplified because of the vertical arrangement of the spinning device, the threadjoining program is started, and in this the closing member 21 of the suction tube 20 is first controlled by the microprocessor 9 and opened so that a partial vacuum again prevails in the region of the V-shaped nip. After a short time $t_1$ (FIG. 3) required for opening the closing member 21, the microprocessor 9 transmits a control pulse to the bobbin lift-off device 71 which thereupon releases the bobbin S. The bobbin S comes into frictional contact with the bobbin drive roller 70, with the result that the paidout joining thread starts to be drawn off from the thread store 8. At the same time, the partial vacuum in the thread store 8 exerts a restraining force on the joining thread, so that latter is tensioned. The thread tension ensures that the joining thread presses the spring bands 61 and 72 away and runs into the nip line of the pair of draw-off rollers 6, 60 and into the thread transfer slot of the bobbin drive roller 70.

When a thread length exceeding the joining length required has been stored in the thread store 8, the absolute thread end of the joining thread passes the light barrier which serves as a thread sensing device 81 and has previously been made ready for operation and which causes the microprocessor 9 to control the sliver clamping device 31. The control takes place after a delay time $t_2$, co-ordinated with the supply speed of the joining apparatus, relative to the start of the bobbin drive.

When a previously metered thread length, the absolute end of which is not sensed, is contained in the thread store 8, the sliver clamping device is controlled and returned to its initial position, as soon as the joining thread lies taut in the V-shaped nip and is drawn-off uniformly. The time from the start up to the uniform drawoff of the thread can be determined empirically and adjusted.

Together with the return of the sliver clamping device, the fiber feed into the V-shaped nip subjected to suction begins again, and in the latter the fibers come up against the joining thread running off and attach themselves to it. So as not to disturb the spinning process, the partial vacuum in the thread store 8 is cut off again. For this purpose, after a time $t_3$ after the return of the sliver clamping device, the microprocessor controls the closing member 80 of the thread store 8 which is thereupon brought into the closing position.

The exact calculation of the times $t_1$, $t_2$ and $t_3$ is of essential importance for the success of the threadjoining operation and for the strength and appearance of the join. Thus, the time $t_1$ should be calculated so that the bobbin S comes in contact with the bobbin drive roller 70 as soon as the full vacuum is exerted on the friction roller 2. The time $t_2$ between the start of the bobbin drive and the opening of the sliver clamping device 31 must be fixed so that, at the start of the fiber feed into the V-shaped nip, the joining thread lies taut in the V-shaped nip. Finally, the partial vacuum in the thread store 8 must be maintained at least until the joining thread has been drawn off completely from the thread store, in order to ensure the thread is always held tautly when being drawn off. The time $t_3$ between the opening of the sliver clamping device 31 and the closing of the thread store 8 must be of corresponding length.

The apparatus according to the invention can be modified in various ways. Thus, instead of a microprocessor, any other suitable control device can be provided for the time-program control of the bobbin lift-off device 71, the sliver clamping device 31 and the closing members 21 and 80. Likewise, if appropriate, the drive of the opening roller 4 can also be interrupted before the joining thread is paid out in front of the V-shaped nip. It has been shown, however, that the joining operation takes place faultlessly even when the opening roller continues to rotate. The joining thread can be introduced into the thread store reliably and in a way not adversely affected either by the air stream generated by the opening roller or by the air vortex arising when the friction rollers continue to rotate, for example if the partial vacuum in the thread store is calculated appropriately. Furthermore, the pressure roller 60 of the pair of draw-off rollers can also be lifted off from the drive roller 6 before the joining thread is paid out. In this case, the spring band 61 can be omitted.

The process according to the invention and the apparatus for carrying it out have been described with reference to a friction-spinning device, in which the fiber feed channel is arranged close above the spinning gusset, so as to supply the fibers directly to the yarn formation zone. If the fiber feed channel is arranged in another way, for example laterally relative to the spinning gusset (German Offenlegungsschrift No. 3,300,636), it is not necessary to pay out the returned joining thread close in front of and along the V-shaped nip and at the same time interrupt the suction exerted on the V-shaped nip before the paying-out operation. It is also possible, when the suction exerted on the V-shaped nip is not interrupted, to guide the thread end back into the store and pay it out at a greater distance from the friction rollers. In this case, there must be no interruption in the suction exerted on the V-shaped nip before the paying-out operation.

In FIG. 4 the thread store 8 is arranged in a servicing trolley W movable along the spinning units. Here, the thread store 8 is designed as a hose which is provided with a suction nozzle 83. For joining, the suction nozzle 83 is moved, by means of a gripper 91 mounted movably on the servicing trolley W, out of its initial position in the vicinity of the end of the friction rollers facing away from the pair of draw-off rollers 6, 60 into a position 83' in front of the bobbin S, in order to search for the thread end on the bobbin, suck it up and deliver the thread length necessary for joining back into the thread store 8. Subsequently, the gripper 91 brings the suction nozzle 83 back into its initial position, so that the thread is paid out in front of the V-shaped nip. The gripper 91 then moves the suction nozzle 83 in the direction of the plane of the V-shaped nip into a position 83'', with result that the thread extending from the bobbin S into the thread store 8 comes to rest in the V-shaped nip. At the same time as the movement of the suction nozzle 83 into the position 83'', the bobbin is brought in contact with the bobbin drive roller 70 and the thread draw-off from the thread store 8 is thus started. When the thread end passes the thread sensing device 81 (FIGS. 1 and 2) which in this case can be arranged in the suction nozzle 83, the fiber feed into the V-shaped nip subjected to suction is resumed in the way already described.

When this method of paying out the thread for joining is used, there is no need either to control the movement of the thread store relative to the thread end as regards the friction rollers particularly accurately or to interrupt the suction exerted on the friction rollers and their drive.

To obtain a firm and inconspicuous join, here too the thread end is prepared for joining. For this purpose, in a space-saving way the device 81' necessary for this is arranged in the thread store 8 (FIGS. 4 and 5). The device contains a suction nozzle 50 with a tubular shroud 51 connected to the partial vacuum source. The suction nozzle 50 is designed so that it generates a turbulent flow of suction air in the shroud. The thread delivered back into the thread store 8 and extending beyond the shroud 51 in the direction of the closing member 80 is first severed in the shroud 51 by means of a knife 52 pressed against an anvil 53, whereupon the free thread end F' is made to execute whip-like oscillations as a result of the turbulent suction-air stream. As a result, fiber ends are spread off from the thread surface and the thread acquires a rougher surface. To speed up the preparation of the thread end, the inner wall of the shroud 51 can be provided with edge-like projections, such as those provided, for example, by knurling. Other devices for preparing the thread end can of course also be used and arranged in the thread store 8.

Because of this arrangement of the thread-end preparation in the thread store, not only is space saved in the servicing device, but there is also no need for the separate starting-up of such a thread-end preparation, thus resulting in substantial simplifications and a shortening of the thread-joining operation.

We claim:

1. A process for rejoining a thread for restarting the spinning process on an open-end friction-spinning device, in which fibers are fed into a V-shaped nip formed by two driven friction rollers and subjected to suction, and the thread formed in the V-shaped nip is drawn off from the nip and wound onto a bobbin driven by drive roller, comprising the steps of:

providing a joinable length of a thread end for the V-shaped nip;

storing a predetermined length of said thread at the end of the V-shaped nip opposite the bobbin;

starting the thread draw off in coordination with the friction roller speed;

twisting said thread; and starting the fiber feed into the V-shaped nip formed by said driven friction rollers when a predetermined length of thread remains in said storage, whereby a smooth uniform length joint is formed between the thread being formed by the friction rollers and the thread end which had been stored.

2. A process as claimed in claim 1, wherein the thread end is laid out in front of a vertically extending V-shaped nip formed by said driven friction rollers.

3. A process as claimed in claim 1 or 2, wherein the thread end is stored in a pneumatic storage station.

4. A process as claimed in claim 3, wherein the suction exerted on the V-shaped nip is interrupted before the laying-out operation.

5. A process as claimed in claim 4, wherein the friction elements are cleaned before the laying out of the thread end by being driven in the opposite direction to the direction of rotation for spinning, the residual fibers coming loose from them being sucked into the storage station.

6. A process as claimed in claim 5, wherein a metered thread length is stored in the storage station.

7. A process as claimed in claim 5, wherein a thread length exceeding a predetermined joining length is stored in the storage station, and the absolute thread end is sensed during the thread draw-off.

8. A process as claimed in claim 7, wherein the thread end laid out in front of the V-shaped nip is held elastically at a distance from the thread transfer device.

9. A process as claimed in claim 8, wherein the thread end drawn off from the bobbin is guided laterally past a pair of draw-off rollers and is held elastically at a distance from the nip line of the pair of draw-off rollers.

10. A process as claimed in claim 9, wherein the thread end is prepared for joining before the laying-out operation.

11. An apparatus for rejoining a thread for restarting the spinning process on an open-end friction spinning device, said spinning device comprising:

two rotationally symmetrical friction elements supported on a frame to form a V-shaped nip, at least one of which is perforated and is connected to a suction device by a suction tube;

a fiber feeding device having a sliver supply and an opening device;

a pair of draw off rollers;

a spooling device;

a thread monitor arranged between said draw off rollers and said spooling device;

a lift off device for lifting the bobbin off its drive means;

a sliver clamping device disposed adjacent to the sliver supply device; and a thread storage device arranged in front of the friction element in a position to retrieve and to store broken ends of thread.

12. An apparatus as claimed in claim 11 wherein the thread storing means comprises a suction tube and a shutoff valve.

13. An apparatus as claimed in claim 12 which further comprises control means for activating the bobbin lift off device, to close the sliver clamping device, to open the shut off valve of the thread storing means, and to close the shut off valve of the suction device for the frictional elements whenever the thread monitor detects a broken thread.

14. An apparatus as claimed in claim 12 which comprises a control means for activating the bobbin lift off device to re-engage the bobbin with its drive roller, the sliver clamping device to release the sliver;

opening the shutoff valve of the suction tube for the friction elements; and for closing the shut off valve of the thread storage in accordance with a predetermined, time controlled program.

15. An apparatus as claimed in claim 14, wherein the control is carried out by means of a microprocessor 16. An apparatus as claimed in claim 15, wherein a thread sensing device is assigned to the thread store.

17. An apparatus as claimed in claim 16, wherein the thread sensing device is a light barrier.

18. An apparatus as claimed in claim 12, wherein the thread storage device is at the same time a suction device for removing loose fiber from the friction elements.

19. An apparatus as claimed in claim 18, wherein an elastic thread guide element is arranged in front of the thread transfer device belonging to the spooling device.

20. An apparatus as claimed in claim 19, wherein the pair of draw-off rollers has assigned to it an elastic thread guide element which holds the thread at a distance from it.

21. An apparatus as claimed in claim 20, wherein the friction elements are arranged vertically upright.

22. An apparatus as claimed in claim 21, wherein the thread store is arranged in a servicing trolley movable along the spinning units.

23. An apparatus as claimed in claim 22, wherein the thread store has a suction nozzle which can be moved out of an initial position and which is intended for paying-out the thread.

24. An apparatus as claimed in claim 23, wherein the suction nozzle can be moved relative to the bobbin in order to search for and suck up the broken thread end.

25. An apparatus for rejoining a thread, especially as claimed in claim 24, wherein a device for preparing the free thread end is arranged in the thread store.

26. An apparatus as claimed in claim 25, wherein the suction nozzle is part of the thread store and is fastened to a gripper, by which it can be moved out of an initial position into a thread search position, back to the initial position for paying-out the thread in front of the V-shaped nip and out of the initial position into a position for inserting the thread into the V-shaped nip.

27. A process for rejoining a thread on an open-end friction-spinning device, in which fibers are fed into a V-shaped nip subjected to suction, and the thread formed in the V-shaped nip is drawn off from said V-shaped nip and wound onto a bobbin, and, for rejoining, a thread end is drawn off from the bobbin and guided towards the V-shaped nip, wherein the thread drawn off from the bobbin is first laid out in front of the V-shaped nip and is stored in a predetermined length in a storage station, and wherein the thread is then inserted into the V-shaped nip from this position, whereupon, after a predetermined time, the fiber feed into the V-shaped nip is resumed.

28. A process as claimed in claim 27, wherein the thread draw-off from the storage station takes place together with the start of the movement of the thread from the paying-out position into the V-shaped nip.

29. A process as claimed in claim 27 or 28, wherein the suction exerted on the V-shaped nip is maintained during the entire paying-out operation.

30. A process as claimed in claim 1, wherein the fiber feeding is started a predetermined time after the thread draw off is started.

* * * * *